United States Patent [19]

Sorensen

[11] Patent Number: 4,909,158

[45] Date of Patent: Mar. 20, 1990

[54] COMBINED WALL CABINET AND SEL-CONTAINED, RETRACTABLE IRONING BOARD

[76] Inventor: Jake A. Sorensen, 1746 N. Heather Dr., Orem, Utah 84057

[21] Appl. No.: 155,134

[22] Filed: Feb. 11, 1988

[51] Int. Cl.[4] ..... A47B 3/00

[52] U.S. Cl. ..... 108/40; 108/42

[58] Field of Search ..... 108/40, 47, 39, 48; 247/145, 146

[56] References Cited

U.S. PATENT DOCUMENTS

| | | | |
|---|---|---|---|
| 1,110,903 | 9/1914 | Cox | 108/40 |
| 1,207,747 | 12/1916 | Grimshan | 108/40 |
| 1,568,228 | 1/1926 | Lippert | 108/40 |
| 1,679,581 | 8/1928 | McCray | 108/40 |
| 1,696,145 | 12/1928 | Wagoner | 108/139 |
| 1,699,496 | 1/1929 | Wasmuth | 108/40 |
| 2,358,906 | 9/1944 | Bullard | 108/40 |
| 2,527,682 | 10/1950 | Lyon | 108/40 |
| 2,549,723 | 4/1951 | Thatcher | 108/40 X |

*Primary Examiner*—Kenneth J. Dorner
*Assistant Examiner*—José V. Chen

[57] ABSTRACT

A combined wall cabinet and retractable ironing board is adapted for installation in an elongate, recessed opening in a wall between vertically aligned, spaced apart, support members such as studs. The wall cabinet is generally rectangular in shape and comprises vertical sidewalls, an upper end wall and a lower end wall. A rectangular rear panel forms the back side of the cabinet and is inserted into the depth of the opening in the wall. The cabinet has a lower opening adjacent to the lower end wall, with the lower opening being open to the wall cavity beneath the cabinet. A stop is provided adjacent to the lower opening and the lower end of the rear panel. An elongate ironing board is slidably and pivotally positioned in the cabinet with the rear portion of the board capable of extending through the lower cabinet opening, such that when the board is rotated into a near vertical position it will slide downwardly through the lower opening into a portion of the wall beneath the cabinet, and when the board is slid upwardly, with its front portion being rotated downwardly, it will rest in a substantially horizontal position, with the board being restrained from further downwardly rotation by abutment against the stop near the lower end of the rear panel.

9 Claims, 3 Drawing Sheets

COMBINED WALL CABINET AND SEL-CONTAINED, RETRACTABLE IRONING BOARD

BACKGROUND OF THE INVENTION

1. Field of the Invention

The present invention relates to a combined wall cabinet and self-contained, retractable ironing board of the type in which the ironing board is concealed in an interior cavity of the wall when not in use and is accessed through a cabinet mounted in a recess in the wall and having a hinged door for access to the ironing board.

2. State of the Art

It is well known in the prior art to provide storage for an ironing board within an interior cavity of a wall when the ironing board is not in use and to provide access to the ironing board when the board is to be used. A search of the patent literature produced the following patents:

- U.S. Pat. No. 960,213, to A. D. Williams, dated 5/31/10;
- U.S. Pat. No. 1,202,959 to F. M. Biggs, dated 10/31/16;
- U.S. Pat. No. 1,207,747 to A. E. Grimshaw, dated 12/12/16;
- U.S. Pat. No. 1,541,342 to A. I. Friel, dated 6/9/25;
- U.S. Pat. No. 1,568,228 to G. A. Lippert, dated 1/5/26;
- U.S. Pat. No. 2,106,044 to L. R. Young, dated 1/18/38;
- U.S. Pat. No. 2,527,682 to M. H. Lyon, dated 10/31/50; and
- U.K. Pat. No. 372,948 to J. Walker, dated 5/19/32.

The patents to Williams, Biggs, Grimshaw, Friel and Walker all disclose means of housing an elongate ironing board within a cavity between the support members of the wall. An opening is provided in the wall for access to the ironing board. The access opening has a vertical dimension which is at least as large as the elongate dimension of the ironing board. In addition, moving mechanical means comprising guide bars, sliding bearings, slots and tracks for movement of the guide bars and other moving parts are provided for guiding and moving the ironing board within the cavity in the wall.

The patents to Lippert and Young show a wall cabinet combined with an ironing board. In each of the latter patents, the cabinet has a vertical dimension which is at least as great as the longitudinal dimension of the respective ironing board. The cabinet is positioned between adjacent support members within the interior of the wall, and an opening is provided within the upper portion of the cabinet to the inside of the cabinet. A corresponding opening is provided in the outer sheeting of the wall, with the opening in the wall sheeting being in registry with the opening in the cabinet. A substantial portion of the cabinet is positioned within the wall and below the opening in the wall. In new construction, the cabinet must be installed within the wall structure before the wall sheeting is applied. With existing wall construction, the sheeting on the wall in the area of the cabinet must be removed to allow installation of the cabinet, with replacement sheeting being reapplied after placement of the cabinet. In common with the structure of the first mentioned patents, the latter patents both teach the necessity of moving mechanical means comprising guide bars, sliding bearings, slots and tracks for movement of the guide bars and other moving parts in guiding and moving the ironing board within the cabinet.

3. Objectives

A principal objective of the invention is to provide a novel wall cabinet and self-contained, retractable ironing board in which the wall cabinet unit can be installed within a relatively small opening in a wall between vertical support members of the wall, with the wall cabinet unit being constructed such that the cabinet has a vertical dimension no greater than the elongate dimension of the opening in the wall, and the elongate, retractable ironing board has a longitudinal length greater than the cabinet or the elongate dimension of the opening in the wall, and wherein the ironing board is stored, when not in use, in a generally upright, concealed position within the wall and can be pulled upwardly and outwardly from the cabinet to a stable, generally horizontal working position extending outwardly from the base of the cabinet.

A particular objective of the present invention is to provide such a wall cabinet and ironing board combination in which the only moving members are the ironing board itself and the door of the cabinet, with no moving mechanical parts such as swinging braces, guide bars, sliding bearings, and slots and tracks for movement of the guide bars as are contained in the wall cabinets of the prior art.

Another objective of the present invention is to provide such a wall cabinet and ironing board combination in which a storage shelf and electrical outlet are provided within the cabinet.

An additional objective of the present invention is to provide such a wall cabinet and ironing board combination in which the ironing board when stored in its upright position within the wall cavity, is wedged with its bottom end engaging the interior surface of the inner wall cavity and its upper portion contacting a shelf provided within the cabinet itself, with the shelf in turn further being adapted to hold such items as an iron and other ironing aids.

A still further objective of the present invention is to provide such a wall cabinet and ironing board combination which can be readily installed into a wall at any desired height and can further be installed into a wall constructed of any conventional vertical supports such as conventional wood studs.

BRIEF DESCRIPTION OF THE INVENTION

The above objectives are achieved in accordance with the present invention by providing a novel, unique wall cabinet and self-contained, retractable ironing board, wherein the ironing board is stored within the cabinet and a portion of the wall immediately below the cabinet for space-saving convenience and can be readily pulled from its storage position through the open door of the cabinet and pivoted to a stable, generally horizontal working position extending outwardly from the base of the cabinet through the open door of the cabinet.

The ironing board and wall cabinet are designed to be installed in an elongate, recessed opening in a wall, with the recessed opening being positioned between parallel, vertical support members of the wall. The recessed opening generally has a depth substantially the same as the depth of the wall, with the wall sheeting on the opposite sides of the vertical support members forming the inner side of the recessed opening. The wall sheeting on the front sides of the vertical support members is, of course, cut out to the desired height and width of the recessed opening. The vertical, elongate dimension of the recessed opening is preferably about 30 to 36 inches.

The wall cabinet is generally rectangular in shape and comprises parallel, vertical, elongate sidewalls which can be secured to the spaced apart support members of the wall. The sidewalls of the cabinet have a limited elongate dimension such that the sidewalls are insertable into the opening in the wall. An upper, horizontal, end wall and a lower, horizontal, end wall connect the respective end portions of the sidewalls to form the perimeter of the cabinet. The sidewalls and end walls have substantially flat front and rear edges and inner and outer surfaces, with the front edges of the sidewalls and end walls being flush with each other to form an open front of the cabinet. The back edges of the sidewalls and upper end wall are flush with each other, but the back edge of the lower end wall falls short of the back edges of the sidewalls to form a bottom opening in the cabinet as will be described more fully hereinafter.

A rectangular back panel, having front and back surfaces, is connected at the perimeter of the front surface thereof to the flush rear edges of the sidewalls and upper end walls to form a closed back wall of the cabinet. As mentioned previously, the lower end wall of the cabinet has a width from front to back edge which is smaller than the front to back width of the sidewalls and upper end wall of the cabinet, so as to form a lower opening adjacent to the lower end wall of the cabinet. This lower opening is defined by the lower portions of the sidewalls, the lower end of the rear panel and the back edge of the lower end wall. A stop, whose function will be described hereinafter, is provided adjacent to the lower opening and the lower end of the rear panel. The front of the cabinet is provided with an outwardly swinging, rectangular, front door which is pivotally connected to one sidewall of the cabinet adjacent to the front edge of such sidewall. The door provides a decorative closure for the front of the cabinet, and is, thus, sized to at least cover the otherwise open front face of the cabinet.

An elongate ironing board is provided in association with the wall cabinet. The ironing board comprises a panel having flat upper and lower surfaces, parallel side edges, a rear portion having a rear edge and a front portion having a front edge. The panel forming the ironing board has a length greater than either the longitudinal dimension of the opening in the wall or the vertical, elongate length of the cabinet.

The ironing board is adapted to be slidably and pivotally positioned within the cabinet, with the rear portion of the ironing board being capable of extending through the lower opening at the bottom of the cabinet such that when the board is rotated into a near vertical position, it will slide, for storage purposes, downwardly through the lower opening in the cabinet and into an adjacent portion of the wall beneath the cabinet. When the ironing board is to be used, it is adapted to be moved upwardly from the portion of the wall beneath the cabinet. As the ironing board is being moved upwardly, the front end of the board is rotated downwardly to rest in a substantially horizontal position extending outwardly from the base of the cabinet. The board is retained in the substantially horizontal, working position and restrained from further downward rotation by abutment of the upper surface of the rear portion of the board against the stop positioned adjacent to the lower end of the rear panel of the cabinet, while the lower surface of the rear portion of the ironing board rests on the inner surface of the lower end wall of the cabinet.

Additional objects and features of the invention will become apparent from the following detailed description, taken together with the accompanying drawings.

THE DRAWINGS

A preferred embodiment of the present invention representing the best mode presently contemplated of carrying out the invention is illustrated in the accompanying drawings in which.

Figure 1:
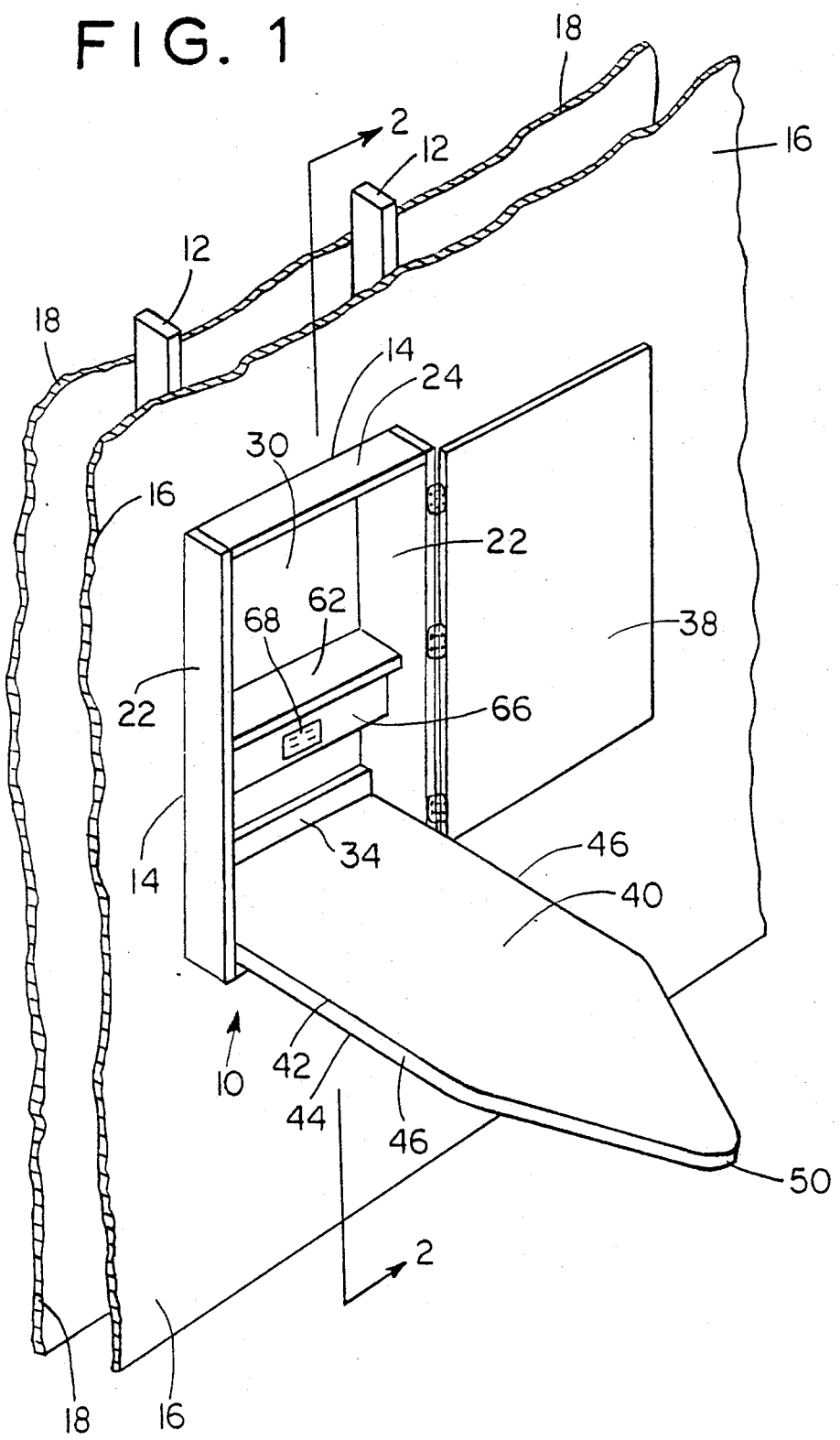
FIG. 1 is a pictorial representation of a combination wall cabinet and self-contained, retractable ironing board installed in a recess between studs in a wall and showing the ironing board in its withdrawn, work position.
Figure 5:
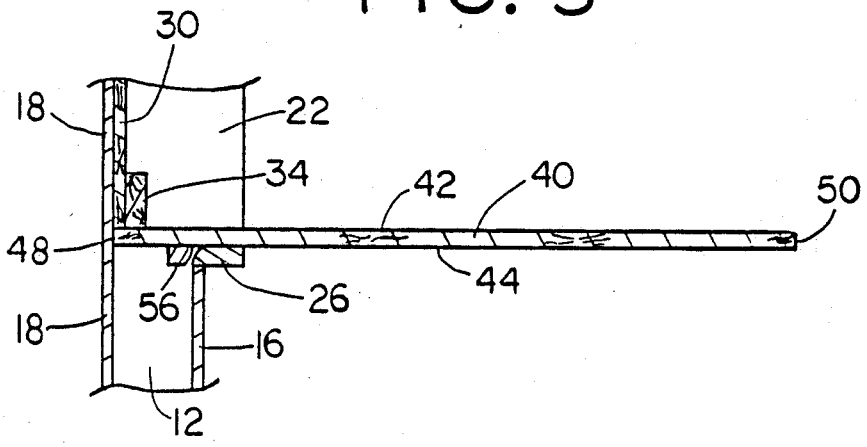
Figure 6:
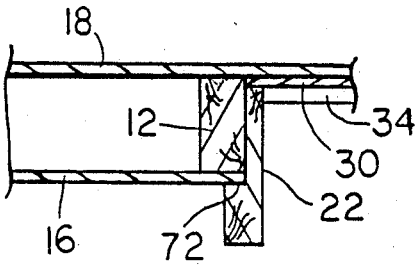

FIG. 5 is a partial, vertical section taken along line 2—2 of FIG. 1 but showing only the bottom portion of the wall cabinet, with the bottom or base of the ironing board being held securely in it substantially horizontal, working position; and FIG. 6 is a cross section through a modified embodiment of a sidewall of the cabinet of the present invention showing how the sidewalls and end walls of the cabinet can be made to form a self-molding edge about the opening which is cut in the wall for the cabinet.

DETAILED DESCRIPTION OF THE ILLUSTRATED EMBODIMENTS

Referring now to the drawings, there is shown a preferred embodiment of a combined wall cabinet and retractable ironing board in accordance with the present invention. The wall cabinet and self-contained ironing board are shown installed in an elongate, recessed opening in a wall between vertically aligned, spaced apart, support members such as studs 12. The studs 12 can be common 2×4 boards as used in conventional housing construction or they can be larger boards, such as 2×6's or 2×8's used in commercial construction. The vertical support members can also be made of steel or other metal members which resemble the wooden counterparts.

The wall cabinet, shown generally by the reference numeral 10 in the drawings, is generally rectangular in shape and is designed to be received in an elongate, recessed opening between adjacent studs 12 in a wall. The opening 14 (FIG. 1) is formed by cutting the sheeting 16 of the wall between the vertical support members 12 to the proper size to allow insertion of the cabinet 10.

The opening 14 will generally have a depth substantially the same as the depth of the vertical support members 12, and the inside face of the sheeting 18 on the opposite sides of the vertical support members 12 forms a closed, inner side of the recessed opening. The cabinet 10 is sized such as to fit snugly between the vertical support members 12. Generally, the support members 12 in conventional construction are spaced apart by a distance of 16 inches center-to-center, and the cabinet 10 is readily made to fit between these standard dimensions. As will be described hereinafter, the standard sized cabinet can be installed between vertical support members 12 spaced at greater than 16 inches center-to-center, but a special sized cabinet 10 is required for wall construction utilizing spacings between vertical support member 12 of less than 16 inches.

When the cabinet 10 is installed in standard wall construction, the lateral sides of the opening 14 are cut flush with the inner facing sides of the vertical support members 12. The elongate dimension of the opening 14 cut in the sheeting 16 is the same as the height of the cabinet 10. This will generally be between about 30 and 45 inches. The opening 14 is positioned relative to the floor at any desirable elevation. Generally, the lower edge of the opening 14 will be between about 30 and 45 inches from the floor.

The cabinet 10 is generally rectangular in shape and comprises parallel, vertical elongate sidewalls 22 which are securable to the spaced, wall support members or studs 12 for securing the cabinet within the opening 14. The sidewalls 22 are made of solid wood boards which have an elongate length that is no greater than the elongate dimension of the opening 14. An upper, horizontal, end wall 24 and lower, horizontal end wall 26 connect the respective end portions of the sidewalls 22.

Preferably, the upper and lower end walls 24 and 26 extend between the vertical sidewalls 22 with the ends of the end walls 24 and 26 abutting the inwardly facing side faces of the vertical sidewalls 22 adjacent the respective ends of the sidewalls 22. In this mode, the longitudinal length of the cabinet is determined by the length of the vertical sidewalls 22, and the sidewalls 22 will have an elongate dimension which is substantially the same as the longitudinal, vertical dimension of the opening 14 in the sheeting 16 of the wall. If the end walls 24 and 26 extend over and abut the opposite ends of the vertical sidewalls 22, then the elongate dimension of the sidewalls 22 should be less than the vertical dimension of the opening 24 by the combined thickness of the two end walls 24 and 26, such that the overall, vertical dimension of the cabinet 10 is again substantially the same as the vertical dimension of the opening 14.

The sidewalls 22 and the end walls 24 and 26 have substantially flat front and rear edges and inner and outer surfaces. The front edges of the sidewalls 22 and end walls 24 and 26 are flush with each other to form an open front of the cabinet 10. The back edges of the sidewalls 22 and the upper end wall 24 are flush with each other, but the width of the lower end wall 26 from front to back edge is considerably less than the front to back width of the sidewalls 22 and the upper end wall 24. The widths of the sidewalls 22 and the upper end wall 24 are preferably greater than the depth of the recessed opening in the wall, i.e., greater than the depth of the vertical wall supports or studs 12, such that the front edges of the sidewalls 22 and end walls 24 and 26 extend outwardly from the outer face of the wall sheeting 16 by at least about one inch and preferably by about two to four inches.

Figure 4:
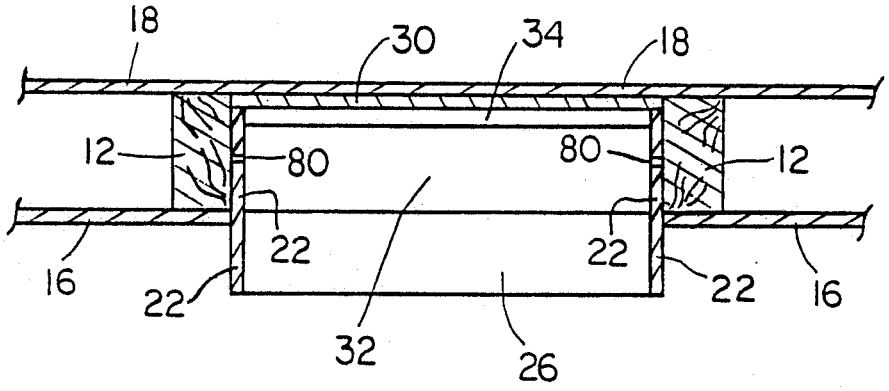
FIG. 4 is a horizontal cross section taken along line 4—4 of FIG. 3.

As mentioned previously, the sidewalls 22 of the cabinet 10 are adapted to be secured to the mutually adjacent studs 12 of the wall. As shown in FIG. 4, the sidewalls 22 are preferably provided with preformed, guide bores 80 through which appropriate fasteners such as screws or finishing nails can be driven into the studs to securely attach the cabinet 10 to the mutually respective studs 12 in the wall.

A rectangular rear panel 30, having front and back surfaces, is connected at the perimeter of its front surface to the flush rear edges of the sidewalls 22 and upper end wall 24. Preferably, the back surface of the panel 30 abuts the inside face of the sheeting 18 on the opposite side of the studs 12, i.e., the cabinet 10 preferably fits into the full depth of the recessed opening in the wall. The width of the lower end wall 26 is then chosen such that its inner edge is adjacent to the inner face of the wall sheeting 16, such that a lower opening 32 (FIGS. 2 and 4) is formed adjacent to the lower end wall and defined by the lower portions of the sidewalls 22, the lower end of the rear panel 30 and the back edge of the lower end wall 26. The opening 32 is thus preferably substantially the same size as the cross-sectional size of the cavity formed between the studs 22 and the front and back sheetings 16 and 18 of the wall, such that the lower end of the cabinet 10 is open through the lower opening 32 to the lower portion of the wall cavity located beneath the cabinet 10.

A stop is provided adjacent to the lower opening 32 and the lower end of the rear panel 30. The stop can be the bottom edge of the rear panel 30, but is preferably at least augmented with a stop board 34 which extends substantially horizontally between the sidewalls 22 and lies flatwise against the front face of the back panel 30. The stop board 34 preferably has a thickness of no more than about an inch and a half.

The stop is positioned with its lowermost side edge being elevated vertically above the upper face of the lower end wall by a distance equivalent to the thickness of the ironing board component of the system. In general, the ironing board, which will be described more fully hereinafter, will have a thickness of between about one-half inch and two inches. Thus, the lowermost side edge of the stop board 34 will generally be elevated above the upper face of the lower end wall 26 by a distance of between about one-half inch and two inches. As illustrated, the bottom edge of the rear panel 30 is flush with the lowermost side edge of the stoop board 34. However, instead of terminating at a lower end which is short of the elevation of the upper face of the lower end wall 26, the rear panel 30 could just as well extend downwardly past the stop board 34 and even beyond the elevation of the lower end wall 26 is so desired.

An outwardly swinging, rectangular, front door 38 is hinged at one of its side edges to the front edge of one of the sidewalls 22. The door 38 is adapted to be swung from a closed position in which the door 38 lies flatwise against the flush front edges of the sidewalls 22 and the upper and lower end walls 24 and 26 to an open position in which the door is swung outwardly from the wall through an angle of at least 90° or more. In the closed position, the door 38 effectively covers the open front of the cabinet 10, and in the open position, the door 38 swings away to fully expose the open front of the cabinet 10.

A retractable ironing board is provided which is adapted to be self-contained within the cabinet 10. The ironing board comprises a panel 40 having flat upper and lower surfaces 42 and 44, parallel opposite side edges 46, a rear portion having a rear edge 48 and a front portion having a front end 50. In a preferred embodiment, as illustrated, the rear edge 48 of the panel 40 forming the ironing board is oriented at right angles with the side edges 46, and the front portion of the panel 40 tapers forwardly and inwardly from the parallel side edges 46 so as to terminate in a generally rounded front end 50. The ironing board, i.e., the panel 40, has a length which is greater than the vertical, elongate dimension of the cabinet 10, that is, greater than the length of sidewalls 22. Preferably, the panel 40 will have a length of at least about 1.25 times the vertical, elongate dimension of the cabinet 10.

Even though the ironing board panel 40 is considerably longer than the vertical dimension of the cabinet 10, it is conveniently adapted to be stored in a retracted, concealed position within the cabinet 10. The ironing board panel 40 is slidably and pivotally positioned in the cabinet 10, with the rear portion of the ironing board panel 40 being capable of extending through the lower opening 32 in the cabinet 10. When the panel 40, i.e., the ironing board, is rotated into a near vertical position, it can be moved downwardly in a sliding motion through the lower opening 32 in the cabinet 10 into a portion of the wall located immediately beneath the cabinet 10. When the ironing board is in the stored position, the bottom portion of the ironing board is concealed within the wall cavity immediately below the cabinet 10, and the upper portion of the ironing board extends into the cabinet 10 and is concealed from view by the door 38 in its closed position covering the otherwise open front of the cabinet 10. The ironing board is thus conveniently stored out of sight, being positioned partly in the wall and partly in the cabinet 10.

The ironing board is easily and quickly extended to a horizontal working position by opening the door 38 of the cabinet 10 and moving the ironing board upwardly in a sliding motion out of the lower opening 32 in the cabinet 10. As the rear edge 50 of the ironing board approaches the lower opening 32 of the cabinet 10, the front portion of the ironing board is rotated downwardly until the ironing board rests in a substantially horizontal, working position. In the working position, the ironing board is restrained from further downward rotation by abutment of the upper surface 42 of the rear portion of the board against the stop, i.e., against the lower edge of the stop board 34, while the lower surface 44 of the rear portion of the board rests on the inner surface of the lower end wall 26.

In the illustrated, preferred embodiment of the invention, an elongate cross board 56 extends transversely across the lower, flat surface 44 of the ironing board 40. The cross board 56 is spaced from the bottom, rear edge 48 of the ironing board 40 by a distance such that when the lower portion of the ironing board is pulled upwardly through the opening 32 at the bottom of the cabinet 10, and the cross board 56 approaches the opening 32, the ironing board 40 can be pivoted about its lower portion or its rear edge 48 to a substantially horizontal position with the cross board 56 abutting the rear side edge of the lower end wall 26 and with the rear edge portion of the ironing board 40 abutting the stop adjacent to the back side of the opening 32 of the cabinet 10. The cross board 56 prevents the ironing board 40 from being pulled in a horizontal direction from the cabinet 10 when the ironing board is in its working position. The mutually facing edges of the cross board 56 and the lower end wall 26 are advantageously rounded or curved as shown in FIG. 5 to facilitate the pivoting movement of the ironing board about its rear edge 40.

Figure 2:
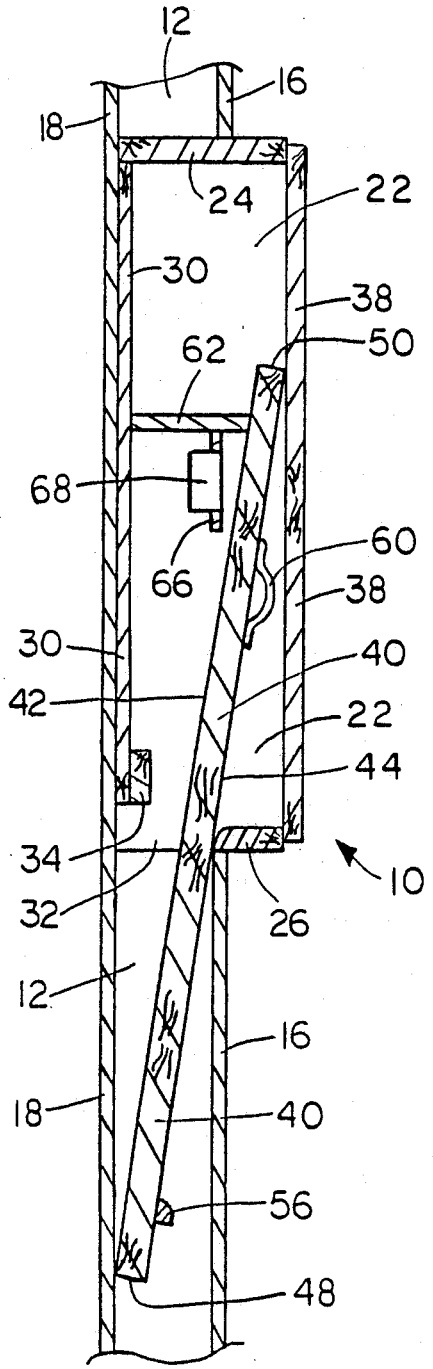
FIG. 2 is a vertical cross section through the wall and cabinet unit of FIG. 1 taken along the line 2—2 of FIG. 1, but showing the ironing board in its retracted, stored position and further showing the door of the cabinet closed to conceal the ironing board from view.
Figure 3:
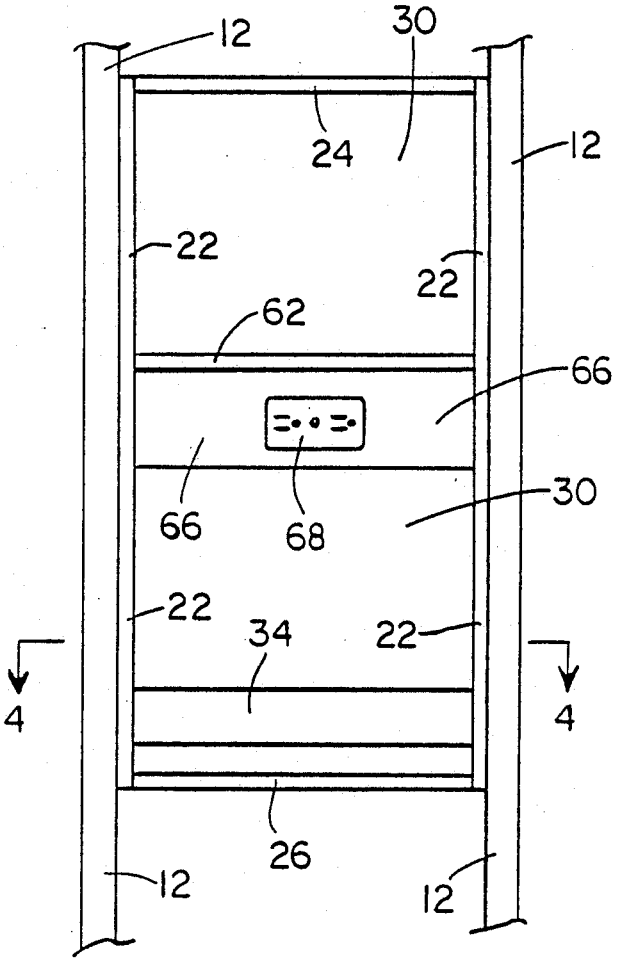
FIG. 3 is a elevation of the front of the cabinet of FIG. 1, showing the sheeting on the wall removed to expose the studs between which the cabinet is installed and further showing the front of the cabinet and the ironing board removed so that the internal parts of the cabinet are visible.

The ironing board 40 can advantageously be provided with a pull handle 60 as shown in FIG. 2 to aid in lifting the ironing board 40 upwardly through the opening 32 in the cabinet 10. The pull handle 60 is preferably provided on the upper portion of the lower surface 44 of the ironing board 40 so that it is readily available for grasping when the ironing board 40 is to be moved from its stored position to its working position.

It is further advantageous to provide a substantially horizontal shelf 62 extending between the sidewalls 22 of the cabinet 10 intermediate the upper and lower walls 24 and 26 of the cabinet 10. Preferably, the shelf 62 is positioned at a location above the lower end wall 26 by a distance of about one-half to two-thirds the elongate dimension of the cabinet 10. The shelf 62 will generally abut the front face of the rear panel 30 and advantageously extends outwardly from the rear panel 30 by a distance of between about two-thirds and three-fourths of the width of the sidewalls 22 of the cabinet 10. Under those conditions, when the lower portion of the ironing board 40 is lowered into the portion of the wall below the opening 32 in the cabinet 10, the board 40 will wedge itself in a slanting vertical position wherein the rear edge 48 of the board 40 abuts the sheeting 18 of the wall, the mid portion of the board 40 abuts the rear edge of the lower end wall 26, and the upper portion of the board 40 abuts the exposed, forward edge of the shelf 62. The forward edge of the shelf 62 can advantageously be canted at the same angle as the ironing board when in the stored position such that the forward edge of the shelf 62 makes flat abutting contact with the ironing board when the ironing board is in the stored position.

In addition to the shelf 62, a flange board 66 having a width of between about 3 to 4 inches can be provided extending between the sidewalls 22 of the cabinet 10 and projecting downwardly from the shelf 62 as shown in the drawings. An electrical outlet 68 can be conveniently mounted on the flange board 66 for use in providing power to an iron when the ironing board is being used. The electrical outlet 68 is, of course, connected to a source of electrical power when the cabinet 10 is installed in the wall.

In a preferred embodiment of the invention as shown in FiG. 6, the sidewalls 22 are made to have a self-molding feature. A cross section of one of the sidewalls 22 is shown in FiG. 6, but it should be noted that the upper end wall 24 and the lower end wall 26 could have a similar cross-sectional shape as shown in FIG. 6 such that they to would exhibit a self-molding feature. As shown in FIG. 6, the outer portion of the sidewall 22 has a thicker dimension than the rear portion thereof, and an abrupt edge 72 is formed in the outer surface of the sidewall 22. When the cabinet 10 is inserted into the opening 24, the flat edge 72 of the enlarged portion of the sidewall 22 abuts against the sheeting of the wall to present a finished appearance similar to having a molding placed between the sidewall of the cabinet and the sheeting on the wall. By enlarging the outer portions of the sidewalls 22 and the end walls 24 and 26, the overall strength of the cabinet is also significantly improved in addition to providing the self-molding feature described above.

Although a preferred embodiment of the combination wall cabinet and ironing board of the present invention has been illustrated and described, it is to be understood that the present disclosure is made by way of example only and that various other embodiments are possible without departing from the subject matter coming within the scope of the following claims, which subject matter is regarded as the invention.

I claim:

1. A combined wall cabinet and retractable ironing board for installation in an elongate, recessed opening in a wall between vertically aligned, spaced apart, support members such as studs, said wall cabinet being generally rectangular in shape and comprising parallel, vertical, elongate sidewalls which are insertable into said opening in the wall and securable to said spaced apart support members, said sidewalls having substantially the same elongate length as the elongate dimension of said opening;

an upper, horizontal, end wall and a lower, horizontal, end wall connecting the respective end portions of said sidewalls;

said sidewalls and end walls having substantially flat front and rear edges and inner and outer surfaces, with (1) the front edges of said sidewalls and end walls being flush with each other to form an open front of said cabinet, (2) the back edges of said sidewalls and upper end wall being flush with each other, and (3) said sidewalls and upper end wall having a width greater than the depth of said recessed opening such that the rear edges of said sidewalls and said upper end wall are positioned within the depth of said recessed opening and the front edges of said sidewalls and said upper end wall extend outwardly from said recessed opening;

a rectangular rear panel having front and back surfaces connected at the perimeter of the front surface thereof to the flush rear edges of said sidewalls and upper end walls;

said lower end wall having a width from front to back edge less than the front to back width of said sidewalls and upper end wall;

a lower opening adjacent to said lower end wall, said lower opening being defined by the lower portions of said sidewalls, the lower end of said rear panel and the back edge of said lower end wall;

a stop adjacent to the lower opening and the lower end of said rear panel; and an outwardly swinging, rectangular, front door pivotally connected to one sidewall adjacent to the front edge thereof and sized to at least cover the open front edges of said cabinet when closed; said ironing board comprising an elongate panel having flat upper and lower surfaces, parallel side edges, a rear portion having a rear edge and a front portion having a front edge, said panel having a length greater than the length of said cabinet;

an elongate cross board extending transversely across the lower surface of said panel;

said ironing board being slidably and pivotally positioned in said cabinet with the rear portion of said board being capable of extending through the lower opening in the cabinet such that when the ironing board is rotated into a near vertical position it will slide downwardly through said lower opening into a portion of the wall beneath the cabinet, and when the board is slid upwardly, with its front portion being rotated downwardly, it will rest in a substantially horizontal position with the board being restrained from further downward rotation by abutment of the upper surface of the rear portion of said board against said stop, while the lower surface of the rear portion of said board rests on the inner surface of said lower end wall of said cabinet; and said cross board is spaced from the rear edge of said panel by a distance such that when the ironing board is pulled upwardly through the lower opening in said cabinet and is pivoted about its rear edge to a substantially horizontal position, the cross board abuts the rear side edge of said lower end wall of said cabinet.

2. A combined wall cabinet and retractable ironing board in accordance with claim 1, wherein said stop comprises a rear stop board extending substantially horizontally between said sidewalls and lying flatwise against the front face of said rear panel.

3. A combined wall cabinet and retractable ironing board in accordance with claim 2, wherein said stop board has a thickness of no more than about two inches extending outwardly from the front face of said rear panel.

4. A combined wall cabinet and retractable ironing board in accordance with claim 3, wherein said stop board is positioned with its lowermost side edge being elevated vertically above the upper face of said lower end wall of said cabinet by a distance of between about one-half inch and two inches.

5. A combined wall cabinet and retractable ironing board in accordance with claim 1, wherein a pull handle is provided on the upper portion of the lower surface of the panel comprising the ironing board to aid in lifting the ironing board upwardly through the lower opening in said cabinet.

6. A combined wall cabinet and retractable ironing board in accordance with claim 1, wherein there is further provided a substantially horizontal shelf extending between the sidewalls of said cabinet, said shelf being positioned above the lower opening in said cabinet by a distance of between about one-half to two-thirds the elongate dimension of said cabinet.

7. A combined wall cabinet and retractable ironing board in accordance with claim 6, wherein the shelf abuts the front face of the rear panel and extends outwardly from said rear panel by a distance of between about two-thirds and three-fourths of the width of said sidewalls of said cabinet, such that when the lower portion of the ironing board is lowered into the wall through the lower opening in said cabinet, the ironing board becomes wedged in a slanting, vertical position in which the rear edge of said ironing board abuts the wall, the intermediate portion of said ironing board abuts the rear side edge of said lower end wall of said cabinet, and the upper portion of said ironing board abuts the exposed edge of said shelf.

8. A combined wall cabinet and retractable ironing board in accordance with claim 6, wherein a flange board having a width of about 3 to 4 inches extends between said sidewalls of said cabinet and projects downwardly from said shelf.

9. A combined wall cabinet and retractable ironing board in accordance with claim 8, wherein an electrical outlet is mounted on said flange board.

* * * * *